US007484372B2

(12) United States Patent
Lee

(10) Patent No.: US 7,484,372 B2
(45) Date of Patent: Feb. 3, 2009

(54) MULTI-BATH APPARATUS AND METHOD FOR COOLING SUPERCONDUCTORS

(75) Inventor: Ron Lee, Bloomsbury, NJ (US)

(73) Assignee: Linde, Inc., Murray Hill, NJ (US)

( * ) Notice: Subject to any disclaimer, the term of this patent is extended or adjusted under 35 U.S.C. 154(b) by 379 days.

(21) Appl. No.: 11/368,798

(22) Filed: Mar. 6, 2006

(65) Prior Publication Data

US 2007/0204632 A1 Sep. 6, 2007

(51) Int. Cl.
*F25B 19/00* (2006.01)
*F25D 23/12* (2006.01)

(52) U.S. Cl. ..... 62/51.1; 62/259.2; 505/899

(58) Field of Classification Search ..... 62/259.2, 62/51.1; 505/885, 899, 892
See application file for complete search history.

(56) References Cited

U.S. PATENT DOCUMENTS 5,220,800 A * 6/1993 Muller et al. ..... 62/51.1
5,584,184 A * 12/1996 Inaguchi et al. ..... 62/6
5,600,522 A 2/1997 Hull
5,956,957 A * 9/1999 Lowry et al. ..... 62/51.1
6,137,388 A 10/2000 Saravolac
6,433,660 B1 8/2002 Saravolac
6,501,970 B2 * 12/2002 Heise et al. ..... 505/163
6,629,426 B2 * 10/2003 Paul et al. ..... 62/259.2
6,664,875 B2 12/2003 Yuan et al.
6,854,276 B1 * 2/2005 Yuan et al. ..... 62/51.1
2006/0064989 A1 * 3/2006 Roth ..... 62/51.1
2006/0065004 A1 3/2006 Lee

OTHER PUBLICATIONS

Chiba et al, "Surface Spark-Over Voltage on Solid Insurlator in Sub-Cool Liquid Nitrogen", ASC Conference, Oct. 2004, 4 pages.
Swaffield et al, "Variable Pressure and Temperature Liquid Nitrogen Cryostat for Optical Measurements with Applied Electric Fields", Measurement Science and Technology, 2004, pp. 2325-2332, vol. 15, IOP Publishing Ltd., UK.

* cited by examiner

*Primary Examiner*—William C Doerrler
(74) *Attorney, Agent, or Firm*—Philip H. Von Neida

(57) ABSTRACT

A multi-bath apparatus and method for cooling a superconductor includes both a cooling bath comprising a first cryogen and a shield bath comprising a second cryogen. The cooling bath surrounds the superconductor, and the shield bath surrounds the cooling bath. The cooling bath is maintained at a first pressure and subcooled, while the shield bath is maintained at a second pressure and saturated. The cooling bath and the shield bath are in a thermal relationship with one another, and the first pressure is greater the second pressure. Preferably, the cryogens are liquid nitrogen, and the superconductor is a high temperature superconductor, such as a current limiter. Following a thermal disruption to the superconductor, the first pressure is restored to the cooling bath and the second pressure is restored to the shield bath in order to restore the superconductor to a superconductive state.

45 Claims, 2 Drawing Sheets

MULTI-BATH APPARATUS AND METHOD FOR COOLING SUPERCONDUCTORS

BACKGROUND OF THE INVENTION

In general, the invention relates to superconductors, and, more specifically, to a multi-bath apparatus and method for cooling superconductors.

DESCRIPTION OF RELATED ART

High Temperature Superconducting (HTS) devices can operate over a wide temperature range, but usually operate best at temperatures below their critical transition temperature. For many HTS devices, these preferred operating temperatures are below the normal boiling point of liquid nitrogen (77.4K).

Superconductors are commonly recognized as ideal current limiters because of an inherent contrast in their electrical conducting capacity between their superconducting and non-superconducting states. Fault Current Limiters (FCLs) are well-known devices that reduce large fault currents to lower levels that can be safely handled by traditional equipment such as circuit breakers. Typically and ideally, an FCL operates in the background of an overall system, e.g., an electric grid, transparent until the occurrence of a fault current event. Upon the occurrence of such an event, the current limiter reduces the intensity of the event so that downstream circuit breakers can safely handle the event. Once the event passes, the circuit breakers and FCL are reset and return to normal, transparent operation.

When a superconductor operates in its superconducting state, it offers little or no electrical resistance. However, when the superconductor operates in its non-superconducting state, its electrical resistance increases dramatically. As a result of these opposing states, superconductors are ideally suited for current limiting applications, and the transition from superconducting (i.e., nearly perfect electrical conductor) to non-superconducting (i.e., normal electrical resistance) states is called quenching. In the context of FCLs, quenching occurs when fault currents occur, effecting the superconductor's transition from a superconducting to non-superconducting state.

Superconducting FCLs are commonly designed so that during normal operation, the operating current remains at or below a specified threshold, during which the superconductor suffers very little or no power loss (i.e., $I^2R$) in operation. However, if a fault current occurs, then the superconducting FCL suddenly provides increased impedance. With these features, superconducting FCLs are rapidly approaching widespread and well-recognized commercial viability.

As noted above, HTS devices operate best at temperatures below the normal boiling point of nitrogen (77.4K). Because nitrogen is typically the medium of choice for cooling HTS devices for reasons of cost and design efficiency, they are typically cooled to a temperature between the normal boiling point and freezing point (63.2K) of nitrogen As is known, for any particular operating temperature above the freezing (or triple) point and below the critical pressure, there is a unique minimum operating pressure for the liquid phase to exist called the saturation pressure. While holding the operating temperature constant and increasing the operating pressure beyond the saturation pressure, liquid nitrogen becomes a subcooled liquid. Subcooled and pressurized liquid nitrogen is an excellent medium for both cooling superconducting FCLs, as well as providing electrical spark over resistance inside the high voltage environment. However, once the superconducting FCL experiences a quench due to a fault current event or events, restoring the superconducting state has proven to be less than quick and efficient. In addition, the advantages of using pressurized, subcooled, liquid nitrogen have been difficult to maintain following a fault current event that disrupts the uniformity of the subcooling.

In sum, superconducting FCLs reduce the effects of fault currents by changing (e.g., increasing) the impedance of the current limiter, from ideally zero during normal operation to a higher current limiting value. Superconductors are ideal to perform this function due to an inherent contrast between their superconducting and non-superconducting states. However, for effective and recurrent use as a FCL, the superconductors must be returned to their superconducting state after a fault current event or events in a quick and efficient manner.

SUMMARY OF THE INVENTION

A multi-bath apparatus and method for cooling a superconductor includes a cooling bath comprising a first cryogen, the cooling bath surrounding a superconducting device and maintained at a first pressure, and a shield bath comprising a second cryogen, the shield bath surrounding the cooling bath and maintained at a second pressure, wherein the cooling bath and the shield bath are in a thermal relationship with one another and the first pressure generally exceeds the second pressure. Preferably, the first cryogen is subcooled, the second cryogen is saturated, the cryogens are, for example, liquid nitrogen, and the superconducting device is, for example, a high temperature superconducting device, such as a fault current limiter. Following a thermal disruption to the superconducting device, the first pressure is restored to the cooling bath and the second pressure is restored to the shield bath.

BRIEF DESCRIPTION OF THE DRAWINGS

A clear conception of the advantages and features constituting inventive arrangements, and of various construction and operational aspects of typical mechanisms provided by such arrangements, are readily apparent by referring to the following exemplary, representative, and non-limiting illustrations, which form an integral part of this specification, in which like reference numerals generally designate the same elements in the several views, and in which.

DETAILED DESCRIPTION OF PREFERRED EMBODIMENTS

Figure 1:
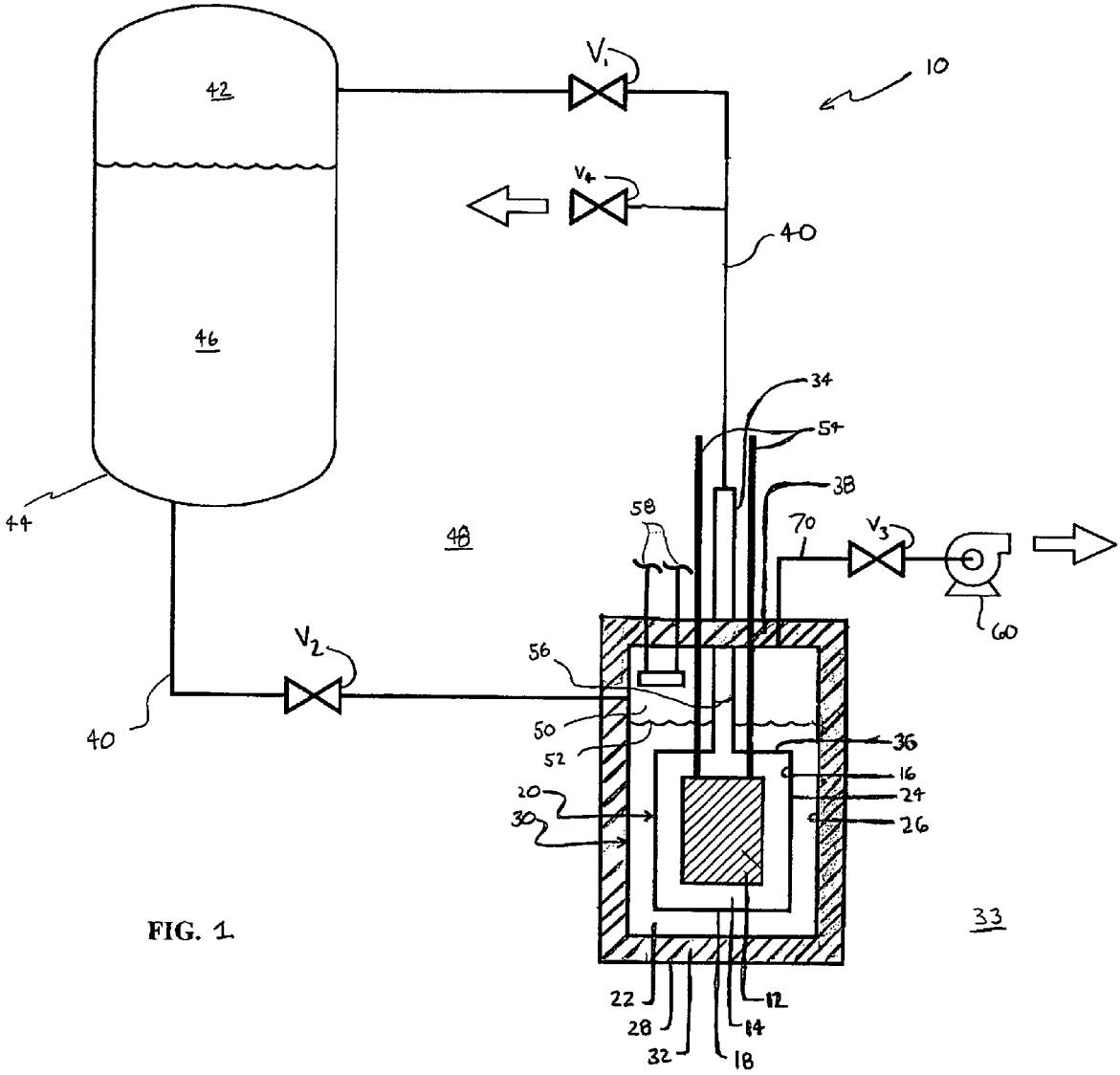
FIG. 1 is a schematic view of a cryogenic system in which the inventive arrangements are practiced according to a first preferred embodiment.

Referring now to FIG. 1, cryogenic system 10 is depicted in which the inventive arrangements are practiced according to a first preferred embodiment. More specifically, FIG. 1 is schematic view of cryogenic system 10 comprising its most basic elements, including superconducting device 12, such as a fault current limiter, transformer, motor, generator, or the like.

Superconducting device 12 is surrounded by, and immersed in, at least partially, and preferably wholly, first cryogen 14 contained within internal walls 16 of inner vessel 18 to define cooling or inner bath 20. In like fashion, inner vessel 18 is surrounded by, and immersed in, at least partially, and preferably wholly, second cryogen 22 contained by and between external walls 24 of inner vessel 18 and internal walls 26 of cryostat 28 to define shield or outer bath 30. As will be elaborated upon, cooling bath 20 and shield bath 30 are in thermal contact (i.e., a heat exchange relationship) with one another, but are otherwise not connected with one another, i.e., the cryogen of one will not mix with the cryogen of the other. Cooling bath 20 is passive in nature, i.e., it simply responds to temperature changes in either superconducting device 12 or shield bath 30. Preferably, a suitable size of cooling bath 20 is chosen to provide adequate cooling to superconducting device 12, and likewise, a suitable size of shield bath 30 is chosen to provide adequate cooling to cooling bath 20, including a suitable ratio between the baths, as desired. As such, cooling bath 20 imparts generally uniform cooling to superconductor 12, and shield bath 30 imparts generally uniform cooling to cooling bath 20.

Preferably, cryostat 28 is formed from standard cryogenic materials, including, for example, vacuum insulation layer 32 formed at and surrounding internal walls 26 of cryostat 28 in order to thermally insulate cooling bath 20 and shield bath 30 from ambient atmosphere 33 outside cryostat 28. Likewise, inner vessel 18 is also preferably formed from standard cryogenic materials, including, for example, preferred metallic materials, such as copper or stainless steel, or non-metallic materials as well.

As indicated, cooling bath 20 comprises first cryogen 14 and shield bath 30 comprises second cryogen 22. Preferably, but not necessarily, first cryogen 14 and second cryogen 22 are liquid forms of a same cryogenic fluid, such as nitrogen, although they are preferably maintained in different thermodynamic states, as will be elaborated upon. Other suitable cryogenic fluids include air, neon, and the like, and first cryogen 14 and second cryogen 22 can also be formed with different cryogenic fluids. Regardless, first cryogen 14 is preferably maintained at an elevated pressure relative to the saturation pressure corresponding to the temperature of second cryogen 22. For the case where both cryogens 14 and 22 comprise the same cryogenic fluid (e.g., nitrogen), then the pressure of first cryogen 14 will be higher relative to second cryogen 22. As a result, first cryogen 14 is subcooled while second cryogen 22 is saturated. In sum:

| BATH | CRYOGEN | PRESSURE | STATE |
|---|---|---|---|
| Cooling Bath 20 | First Cryogen 14 | Higher | Subcooled |
| Shield Bath 30 | Second Cryogen 22 | Lower | Saturated |

The pressure of the outer bath 30 is determined by the temperature of the outer bath because of the saturated state of the second cryogen, i.e., the pressure is such as to maintain the second cryogen 22 at a particular temperature. The pressure of the inner bath 20 is determined by the electrical requirements of the superconductor, i.e., the pressure is such that the first cryogen 14 will prevent or reduce the chance of spark-over due to the high voltage environment. Independently, the temperature of the first cryogen 14, which will generally be nearly the same as that of second cryogen 22, is determined according to the superconducting characteristics and requirements of superconducting device 12. Other than maintaining the required pressure, nothing else is required to achieve the uniform subcooling of the first cryogen 14.

Preferably, inner vessel 18 is in fluid communication with extension pipe 34 extending from surface 36 thereof, into which first cryogen 14 is free to flow, extension pipe 34 extending to and through surface 38 of cryostat 28. Through preferred piping arrangement 40, extension pipe 34 is in open communication with tank headspace 42 (i.e., a region containing gas) of cryogenic storage tank 44, which has a tank headspace 42 above stored liquid cryogen 46. More specifically, during normal standby operation first valve $V_1$ is open and interfaces between extension pipe 34 of inner vessel 18 and tank head space 42 of cryogenic storage tank 44. The pressure of cooling bath 20 is therefore maintained and is generally equal to the pressure within cryogenic storage tank 44.

Stored liquid cryogen 46 in cryogenic storage tank 44 is preferably the same fluid as first cryogen 14 and second cryogen 22. Liquid level 52 defines a liquid/gas interface of shield bath 30. Level 52 is maintained above the top of superconducting device 12, the preferred level dependent upon the plumbing and internal arrangement of the system. Preferred piping arrangement 40 provides for fluid communication between stored liquid cryogen 46 in cryogenic storage tank 44 and shield bath 30. Second valve $V_2$ preferably interfaces between stored liquid cryogen 46 in cryogenic storage tank 44 and cryostat headspace 50 of cryostat 28. Valve $V_2$ is opened when necessary to restore or maintain liquid level 52. In the preferred arrangement 40, and with cryogens 46, 14 and 22 of the same fluid, storage tank 44 will generally be at a pressure greater than second cryogen 22, which ensures flow from storage vessel 44 into shield bath 30 whenever valve $V_2$ is open.

As indicated, superconducting device 12 is surrounded by, and immersed in, at least partially, and preferably wholly, first cryogen 14 contained within internal walls 16 of inner vessel 18 to define cooling bath 20. In addition, superconducting device 12 is in electrical communication with one or more high-voltage power sources (not shown), such as a power grid or the like, through two or more high voltage wires 54 (e.g., 10-200 kV) extending into cryostat 28 to connect to superconducting device 12. High voltage wires 54 connect to superconducting device 12 through cryostat 28 by well-known techniques, such as utilizing a high-voltage bushing interface (not shown).

Because of the physical, and therefore thermal, connection between cooling bath 20 and shield bath 30 (the surface area contact of which can be enhanced by using fins or functionally similar surfaces, not shown), the two baths are maintained at the same approximate temperature, which is typically selected based on the desired operating characteristics of superconducting device 12. As previously described, since system 10 generally maintains cooling bath 20 at a higher pressure than shield bath 30, first cryogen 14 will be naturally subcooled.

Preferably, the pressurizing gas in tank headspace 42 of cryogenic storage tank 44 is of the same species of material as the cryogen in cooling bath 20 and the pressurizing gas in extension pipe 34. The pressure of cooling bath 20 is maintained at a level in excess of that of the shield bath. The pressure of cooling bath 20 is preferably maintained through extension pipe 34 in open communication with tank headspace 42 of cryogenic storage tank 44. In normal operation, valve $V_1$ is open, and therefore the pressure of cooling bath 20 will be maintained essentially equal to the pressure of cryogenic storage tank 44.

Preferably, shield bath 30 is maintained at a specified temperature (and hence, pressure) through the use of one or more pressure-maintaining devices. One such device is cooling device 58 (e.g., a mechanical refrigerator, cryocooler, or the like) that is in thermal contact (i.e., a heat exchange relationship) with the cryostatic headspace 50 of cryostat 28. Any heat load into second cryogen liquid 22 will cause it to boil.

Cooling device 58 will condense the second cryogen gas back into a liquid. In other words, the cooling provided by cooling device 58 maintains the desired pressure (and hence, temperature) of shield bath 30.

Alternatively, system 10 can also maintain shield bath 30 at the specified pressure (and hence, temperature) and liquid level 52 without using cooling device 58 by combining the following: i) vent line 70 coupled to vacuum blower 60 (another pressure-maintaining device) actuated by valve $V_3$—by which the opening and closing of valve $V_3$ and speed of blower 60 are controlled at a time, rate and amount to maintain the desired pressure of shield bath 30, preferably by applicable control logic (not shown), and ii) liquid replenishment from stored liquid cryogen 46 in cryogenic storage tank 44, actuated by valve $V_2$ of preferred piping arrangement 40—by which the opening and closing of valve $V_2$ is controlled at a time, rate and amount to maintain desired liquid level 52 of second cryogen 22 of shield bath 30, preferably by applicable control logic (not shown). Vacuum blower 60 is only required if the required pressure of shield bath 30 is below that of ambient atmosphere 33 outside cryostat 28.

Because of the physical, and therefore thermal, connection between cooling bath 20 and shield bath 30, liquid level 56 of first cryogen 14 in cooling bath 20 will naturally rise to at least liquid level 52 of second cryogen 22 in shield bath 30. In this regard and in comparison to outer bath 30, inner bath 20 is passive. As such, liquid level 56 defines a liquid/gas interface of cooling bath 20 within extension pipe 34. Stated differently, line 40 into extension pipe 34 is a gas pressuring means for the headspace within extension pipe 34. In normal operation, valve $V_1$ is always open and as such, the headspace within extension pipe 34 is at the same pressure as headspace 42 in storage tank 44. The pressure of headspace 42 is maintained separately by any conventional means. This, in turn, advantageously exploits the well-known pressure techniques of bulk storage tanks to cooling the inner bath, and it provides an enormous stability for the system due to the inherent stability of headspace 42. Liquid level 56 of first cryogen 14 of cooling bath 20 will rise to a higher level within extension pipe 34 of inner vessel 18 than liquid level 52 of second cryogen 22, as first cryogen 14 ultimately warms to a higher saturation temperature due to its higher pressure. Active control of liquid level 56 is not required because first liquid cryogen 14 will either boil, or pressurizing gas from extension pipe 34 will condense, to passively maintain liquid level 56 above liquid level 52.

The primary function of line 40 that connects with extension pipe 34 is to provide a pressurizing gas to the first cryogen. A secondary function of line 40 is to provide the gas that will condense to produce the liquid level 56 of cooling bath 20. However, a high-pressure gas storage tank in combination with a pressure regulator (neither shown) can also provide such a pressurizing gas, although this provision does not offer the same level of stability as does the relatively large headspace in a liquid cryogen storage tank.

Typically, the temperature (and hence, pressure) of stored liquid cryogen 46 in cryogenic storage tank 44 will be higher than the temperature (and hence, pressure) of second cryogen 22 of shield bath 30, so a certain amount of flash may result as stored liquid cryogen 46 is introduced into shield bath 30. Unchecked, this flash gas can cause an unacceptable pressure rise in shield bath 30. This flash gas is normally condensed, and pressure in shield bath 30 is maintained, by the action of cooling device 58. If desired, valve $V_3$ and vacuum blower 60 can also cooperate to moderate these effects.

The normal recovery from a thermal disruption of the inner bath is through the shield bath. As previously described in the figures, superconductor 12 is in electrical communication with a power grid or the like through two or more high voltage wires 54 (e.g., 10-200 kV) extending into cryostat 28 to connect to superconducting device 12. Thus, if the power grid or the like experiences a thermal disruption (e.g., a fault current event), then superconducting device 12 will transition into a non-superconductive state. When this happens, the heat generated is released to, and absorbed by, first cryogen 14, which is subcooled. More specifically, the temperature of first cryogen 14 in cooling bath 20 will naturally rise, and may partially vaporize, to accommodate the thermal energy release from superconducting device 12. The temperature rise in cooling bath 20 will naturally cause an increase in the transfer of heat from cooling bath 20 to second cryogen 22 in shield bath 30. Because second cryogen 22 is saturated, this increase in heat transfer will cause a corresponding increase in the vaporization occurring within shield bath 30. The increase in vaporization in shield bath 30 due to a thermal disruption may be sufficiently large that the pressure (and hence, temperature) will rise.

During or shortly after a thermal disruption, restoration of the environment within cryostat 28 as quickly as possible is desirable in order to return superconducting device 12 to its superconducting state, and prepared for another possible event. The restoration of a state of readiness will generally require reducing the temperatures of first cryogen 14 and second cryogen 22 below that strictly required to simply restoring the superconducting state. In other words, the return of first cryogen 14 and second cryogen 22 to their respectively subcooled and saturated original operating states is desirable. The cooling device 58 and/or vacuum blower 60 will be able to function normally following a thermal event to restore the previous thermal environment in cryostat 28. If the system is equipped with both cooling device 58 and blower 60, then both can be operated to speed recovery. Closing $V_2$ during this recovery mode, to avoid the flash of stored liquid cryogen 46 as it enters shield bath 30, can serve as an assist to the recovery process.

Some or all of the excess heat build-up that flowed from superconducting device 12 into cooling bath 20 may also be quickly dissipated by closing valve $V_1$ and opening valve $V_4$, which will dissipate some or all of the excessive pressure (and hence, temperature) of cooling bath 20, which may also be facilitated by using a vacuum blower (not shown), or the like, in communication with valve $V_4$, which is in direct communication with extension pipe 34 from inner vessel 18. The de-pressurization of cooling bath 20 to facilitate removal of excessive pressure (and hence, temperature) is only permissible if superconducting device 12 and the high voltage environment are in a state during the recovery process that will permit the loss of pressure and associated reduction in resistance to electrical spark-over.

During a thermal disruption, a portion of first cryogen 14 may flash and be lost, but, through proper control, liquid level 56 of first cryogen 14 should not drop sufficiently low so that it would prevent normal cooling operations of superconducting device 12 within cryostat 28. While liquid level 56 of first cryogen 14 of cooling bath 20 may be lower than it was prior to the thermal disruption due to vapor loss, it recovers naturally by condensing head space vapor from cooling bath 20 within extension pipe 34, until prior liquid level 56 of first cryogen 14 is restored. Likewise, liquid level 52 of second cryogen 22 of shield bath 30 may also be lower than it was prior to the thermal disruption due to flashing, but it may be restored by opening valve $V_2$ in order to replenish its supply from stored liquid cryogen 46 in cryogenic storage tank 44, until prior liquid level 52 of second cryogen 22 is restored. In other words, condensation from cooling bath 20 within extension pipe 34 replenishes first cryogen 14, and stored liquid cryogen 46 replenishes second cryogen 22, as necessary.

Figure 2:
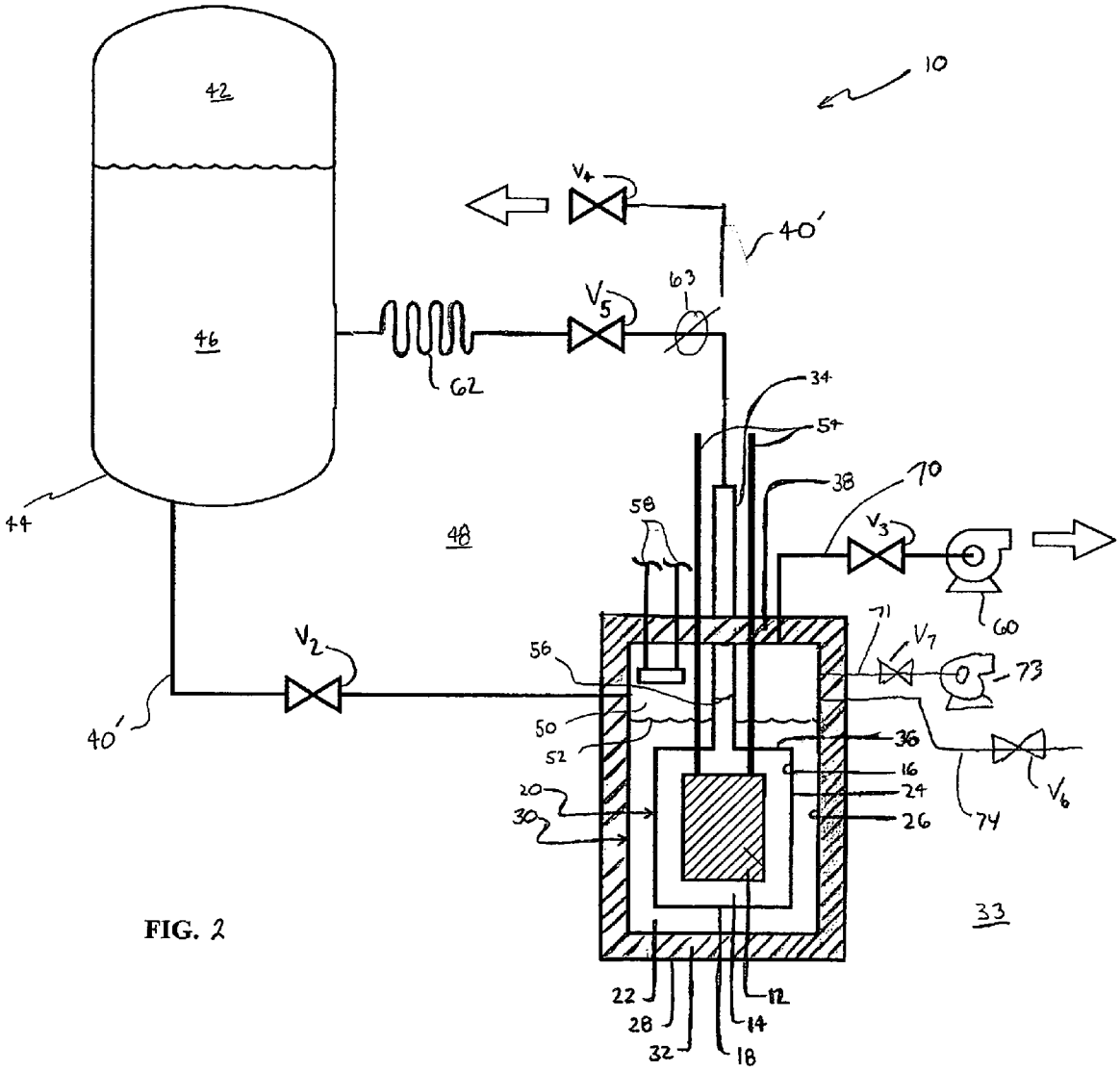
FIG. 2 is a schematic view of a cryogenic system in which the inventive arrangements are practiced according to a second embodiment.

The schematic arrangement of system 10 in FIG. 1 was intended to be representative only. As a result, numerous alternative arrangements are also possible within the scope of the invention. For example and as shown in FIG. 2, instead of arranging extension pipe 34 in open communication with tank headspace 42 of cryogenic storage tank 44 through valve $V_1$, an alternative piping arrangement 40' positions extension pipe 34 in fluid communication with stored liquid cryogen 46 in cryogenic storage tank 44 through vaporizer 62, fifth valve $V_5$ and pressure regulator 63 in order to turn stored liquid cryogen 46 into a gas to maintain the desired pressure in extension pipe 34 for cooling bath 20. Pressure regulator 63 is an optional element that would enable storage tank 44 to operate at an arbitrarily higher pressure than cooling bath 20. Alternatively, the source of the pressurizing gas can be from yet another storage tank for pure gas (not shown), that is of the same type of material as first cryogen 14 or a non-condensable gas such as helium. While preferred, a storage tank containing liquid cryogen is not necessary to maintain or restore the inventory of second cryogen 22 within shield bath 30. Cooling device 58 can be employed to condense an arbitrary source of gas of the same material as second cryogen 22. Finally, although only one is depicted for simplicity, cryogenic storage tank 44 may be in open and fluid communication with more than one cryostat 28, if desired, and cryostat 28 may be maintained by more than one cryogenic storage tank 44. Additionally, cryostat 28 may contain more than one superconducting device 12.

In yet another alternative arrangement for recovery from a thermal disruption, cryostat 28 is equipped with additional lines 71 and 74 (FIG. 2). The purpose of these lines is best illustrated with an example where all cryogens are nitrogen. In this example, the desired operating temperature of the second cryogen 22 is 70K, which corresponds to a pressure of 0.39 bar,abs (−9.1 psig). At the occurrence of a fault current event, the temperature of second cryogen 22 rises to 80K, which corresponds to a pressure of 1.37 bar,abs (5.2 psig). At this point a staged pressure recovery can be implemented. First, sixth valve $V_6$ on line 74 is opened to reduce the pressure to about 0 psig, and is then re-closed. Then seventh valve $V_7$ opens and second vacuum blower 73 is operated to reduce the pressure to about −5 psig. Alternatively, second vacuum blower 73 can be replaced by any one of a number of functionally similar devices, e.g., an ejector or jet pump. After the pressure has been lowered to about −5 psig, valve $V_7$ is closed and second vacuum blower 73 is stopped. Valve $V_3$ and vacuum blower 60 on line 70 are then operated to reduce the pressure to the desired and original −9.1 psig (and thus the desired temperature).

While illustrated with discrete, staged steps, it is apparent that the stages may be overlapped in some cases. For example, vacuum blower 60 may be operated at the same time second vacuum blower 73 is started. Also, fill valve $V_2$, as discussed earlier, may be delayed from operating during the recovery operation to minimize flash gas. In this alternative arrangement, valve $V_6$ and second vacuum blower 73 provide an inexpensive means to greatly reduce the time required to recover from a thermal event.

It should be readily apparent that this specification describes exemplary, representative, and non-limiting embodiments of the inventive arrangements. Accordingly, the scope of this invention is not limited to any of these embodiments. Rather, the details and features of these embodiments were disclosed as required. Thus, many changes and modifications—as apparent to those skilled in the art—are within the scope of the invention without departing from the spirit hereof, and the inventive arrangements necessarily include the same. Accordingly, to apprise the public of the scope and spirit of this invention, the following claims are made.

What is claimed is:

1. A multi-bath apparatus for cooling a superconducting device, the apparatus comprising a:

A. Cooling bath comprising a first cryogen, the cooling bath surrounding the superconducting device and maintained at a first pressure; and B. Shield bath comprising a second cryogen, the shield bath surrounding the cooling bath and maintained at a second pressure;

in which the cooling bath and the shield bath are in a thermal relationship with one another and the shield bath provides cooling to the cooling bath, and the first pressure exceeds the second pressure.

2. The apparatus of claim 1 in which the first cryogen is subcooled.

3. The apparatus of claim 1 in which the second cryogen is saturated.

4. The apparatus of claim 1 in which the first cryogen is subcooled and the second cryogen is saturated.

5. The apparatus of claim 1 in which the first cryogen and the second cryogen are the same.

6. The apparatus of claim 1 in which at least one of the first cryogen or the second cryogen is liquid nitrogen.

7. The apparatus of claim 1 in which the superconducting device comprises a high temperature superconductor.

8. The apparatus of claim 1 in which the superconducting device is a fault current limiter.

9. The apparatus of claim 1 further comprising a pressure-maintaining device to maintain the second pressure.

10. The apparatus of claim 9 in which the pressure-maintaining device is a cooling device in a thermal relationship with the shield bath.

11. The apparatus of claim 9 in which the pressure-maintaining device is a vacuum device in a fluid relationship with the shield bath.

12. The apparatus of claim 1 further comprising both a cooling device in a thermal relationship with the shield bath and a vacuum device in a fluid relationship with the shield bath.

13. The apparatus of claim 1 further comprising a cryogenic storage tank in fluid communication with at least one of the cooling bath or the shield bath.

14. The apparatus of claim 13 in which the cryogenic storage tank contains at least one of a gas or a third cryogen.

15. The apparatus of claim 14 in which the gas is in fluid communication with the cooling bath.

16. The apparatus of claim 14 in which the gas maintains the first pressure.

17. The apparatus of claim 14 in which the gas and the first cryogen are the same.

18. The apparatus of claim 14 in which the third cryogen is in fluid communication with the shield bath.

19. The apparatus of claim 14 in which the third cryogen maintains a liquid level in the shield bath.

20. The apparatus of claim 14 in which the second cryogen and the third cryogen are the same.

21. A method for cooling a superconducting device, the method comprising:

A. Surrounding the superconducting device with a first cryogen from a cooling bath maintained at a first pressure; and B. Surrounding the cooling bath with a second cryogen from a shield bath maintained at a second pressure;

in which the cooling bath and the shield bath are in a thermal relationship with one another and the shield bath provides cooling to the cooling bath and the first pressure exceeds the second pressure.

22. The method of claim 21 further comprising subcooling the first cryogen.

23. The method of claim 21 further comprising maintaining the second cryogen in a saturated state.

24. The method of claim 21 further comprising subcooling the first cryogen and maintaining the second cryogen in a saturated state.

25. The method of claim 21 in which the first cryogen and the second cryogen are the same.

26. The method of claim 21 in which at least one of the first cryogen and the second cryogen is liquid nitrogen.

27. The method of claim 21 in which the superconducting device is a high temperature superconductor.

28. The method of claim 21 in which the superconductor is a current limiter.

29. The method of claim 21 further comprising operating at least one pressure-maintaining device to maintain the second pressure.

30. The method of claim 29 in which at least one of the pressure-maintaining devices is a cooling device in thermal relationship with the shield bath.

31. The method of claim 29 in which at least one of the pressure-maintaining devices is a vacuum device in fluid relationship with the shield bath.

32. The method of claim 29 in which at least one of the pressure-maintaining devices is a vent in fluid relationship with the shield bath.

33. The method of claim 21 further comprising operating two or more pressure-maintaining devices to maintain the second pressure.

34. The method of claim 33 in which two or more pressure-maintaining devices are operated in either a simultaneous or staged manner to maintain the second pressure.

35. The method of claim 21 further comprising providing a cryogenic storage tank in fluid communication with at least one of the cooling bath or the shield bath.

36. The method of claim 35 further comprising storing at least one of a gas or a third cryogen within the cryogenic storage tank.

37. The method of claim 35 in which the gas is in fluid communication with the cooling bath.

38. The method of claim 35 further comprising maintaining the first pressure with the gas.

39. The method of claim 35 in which the gas and the first cryogen are the same.

40. The method of claim 35 in which the third cryogen is in fluid communication with the shield bath.

41. The method of claim 35 further comprising maintaining a liquid level in the shield bath using the third cryogen.

42. The method of claim 35 in which the second cryogen and the third cryogen are the same.

43. A method of protecting an electrical system from a fault current event, the method comprising the steps of:

A. Providing the electrical system with a fault current limiter;

B. At least partially submerging the fault current limiter in a cooling bath comprising a first cryogen having a first pressure;

C. At least partially submerging the cooling bath in a shield bath comprising a second cryogen having a second pressure, the cooling and shield baths in a thermal relationship with one another and the shield bath provides cooling to the cooling bath; and D. Maintaining the cooling and shield baths such that the first pressure is greater than the second pressure.

44. The method of claim 43 in which the electrical system is an electric grid and the fault current limiter is a high temperature superconducting device.

45. The method of claim 43 in which the first and second cryogens are liquid nitrogen.

* * * * *